US010067474B2

(12) United States Patent
Schmiedchen et al.

(10) Patent No.: US 10,067,474 B2
(45) Date of Patent: Sep. 4, 2018

(54) STRIKING MECHANISM COMPRISING A HAMMER WITH AN ELASTIC ADJUSTABLE STOP

(71) Applicant: Glashuetter Uhrenbetrieb GmbH, Glashuette/Sachsen (DE)

(72) Inventors: Christian Schmiedchen, Reichstaedt (DE); Silko Goldmann, Duerrroehrsdorf (DE)

(73) Assignee: Glashütter Uhrenbetrieb GmbH, Glashütte/Sachsen (DE)

( * ) Notice: Subject to any disclaimer, the term of this patent is extended or adjusted under 35 U.S.C. 154(b) by 164 days.

(21) Appl. No.: 15/057,580

(22) Filed: Mar. 1, 2016

(65) Prior Publication Data

US 2016/0274543 A1 Sep. 22, 2016

(30) Foreign Application Priority Data

Mar. 18, 2015 (EP) ..... 15159693

(51) Int. Cl.

| | |
|---|---|
| ***G04B 21/06*** | (2006.01) |
| ***G10K 1/076*** | (2006.01) |
| ***G04B 23/02*** | (2006.01) |

(52) U.S. Cl.

CPC ..... *G04B 21/06* (2013.01); *G04B 23/026* (2013.01); *G10K 1/076* (2013.01)

(58) Field of Classification Search

CPC ..... G04B 21/06; G04B 23/02; G04B 23/026; G10K 1/072; G10K 1/076

USPC ..... 116/164; 368/101, 243

See application file for complete search history.

(56) References Cited

U.S. PATENT DOCUMENTS

| | | | | |
|---|---|---|---|---|
| 1,213,234 | A * | 1/1917 | Muckle | G04B 21/06 368/243 |
| 1,364,111 | A | 1/1921 | Herschede et al. | |
| 7,021,819 | B2 * | 4/2006 | Schmiedchen | G04B 3/001 368/147 |
| 8,514,670 | B2 * | 8/2013 | Goeller | G04B 21/06 368/243 |
| 9,557,715 | B2 * | 1/2017 | Goldmann | G04B 21/06 |
| 2004/0090869 | A1 * | 5/2004 | Schmiedchen | G04B 3/001 368/72 |
| 2011/0211427 | A1 * | 9/2011 | Pesenti et al. | G04B 21/06 368/243 |
| 2016/0274548 | A1 * | 9/2016 | Goldmann | G04B 21/06 |

FOREIGN PATENT DOCUMENTS

| | | | | |
|---|---|---|---|---|
| CH | 80 995 | | 5/1919 | |
| CH | 703699 | A2 * | 3/2012 | G04B 21/06 |
| CH | 706 190 | B1 | 9/2013 | |
| EP | 451335 | A1 * | 10/1991 | G04B 21/06 |
| EP | 1 574 917 | A2 | 9/2005 | |

(Continued)

OTHER PUBLICATIONS

European Search report dated Oct. 15, 2015 in European Application 15159693, filed on Mar. 18, 2015 ( with English Translation and Written Opinion).

*Primary Examiner* — R. A. Smith

(74) *Attorney, Agent, or Firm* — Oblon, McClelland, Maier & Neustadt, L.L.P.

(57) ABSTRACT

A striking mechanism is provided, including a hammer including an elastic stop that is needle-shaped, and an eccentric supporting the stop in a rest position of the hammer.

17 Claims, 1 Drawing Sheet

(56) References Cited

FOREIGN PATENT DOCUMENTS

| | | | | |
|---|---|---|---|---|
| EP | 2 048 548 | A2 | 4/2009 | |
| FR | 716 629 | | 12/1931 | |
| JP | 6093064 | B2 * | 3/2017 | ..... G04B 23/026 |

* cited by examiner

STRIKING MECHANISM COMPRISING A HAMMER WITH AN ELASTIC ADJUSTABLE STOP

BACKGROUND

The present invention relates to a striking mechanism of a clock.

Striking mechanisms with hammers have long been known in clock movements for generating sounds in the audible range, in that they are mounted to be rotatable around an axis and on their edge have a striking edge, which strikes against a circular gong, for example, when the hammer is rotated by a pre-tensioned drive spring. The oscillation of this gong then generates a desired noise and timbre.

In order to tension the drive spring and accordingly move the striking edges of the hammers away from the gongs prior to the strike, so-called leverages are provided, which cooperate with pins arranged on the hammers, and are controlled by a striking mechanism provided, inter alia, with racks. The majority of hammers can be utilised, for example, in minute repeater striking mechanisms in order to generate different sounds.

However, to prevent the hammers from touching the gongs when in their respective rest positions and to thus allow the gongs to oscillate freely after the strike, so-called countersprings are provided, which are generally made from a harder material than the drive springs and press against the same pin in the opposite direction to the drive spring. The distance between the gong and the striking edge is then arranged by adjusting the positioning of the counterspring in such a manner that there is always a space between these two parts after the strike, and therefore any unwanted additional strikes are prevented.

A minute repeater striking mechanism that uses such an arrangement of hammers is illustrated, for example, in page 219 of the book *Théorie d'horlogerie* by Reymondin, Monnier, Jeanneret, Pelaratti. In conventional clocks comprising such a repeater striking mechanism, the stop of the hammer is released as follows: the pin fastened in the rotatably mounted hammer reaches an end stop at a counterspring screwed onto the plate. This counterspring at the same time has an arm provided with elastic properties and a stable non-elastic arm on the opposite side. An adjusting screw provided with a point presses against this arm. If this adjusting screw is now turned to the right, the point presses against the non-elastic arm of the counterspring and at the same time the elastic arm moves the hammer via the pin in a corresponding direction. If the adjusting screw is turned in the other direction, i.e. the point of the screw moves away from the non-elastic arm, then the counterspring stays in its position. However, to change the position of the counterspring, the fastening screw must be released, and this is only possible if the hands and dial are disassembled.

A similar structure of hammers and countersprings for a striking mechanism is described in the patent document CH 706190, according to which the counterspring is screwed from the dial side and where the adjustment of the position of the counterspring is achieved by means of an eccentric provided with a pin, which is accessible from the dial. The eccentric presses against a hard rear flank of the counterspring in order to move it around its swivel axis.

A disadvantage of these known mechanisms is that the number of parts of the striking mechanism is very high and therefore the entire assembly is particularly long. A further disadvantage is that the adjustment of the rest position of the hammers is delicate, because the fastening screw of the counterspring must be released beforehand and, on the other hand, the adjusting screw adjusting screw is only accessible from the dial side, which renders subsequent correction particularly difficult.

BRIEF SUMMARY

The object forming the basis of the present invention is to overcome these disadvantages.

In the case of the hammer according to the invention, which has an elastic stop, the conventional counterspring and the associated fastening screw can be omitted. Therefore, the number of parts of the striking mechanism is reduced and the assembly simplified in this case.

As previously, a striking mechanism, which contains a hammer according to the invention, allows the adjustment of its rest position to be conducted by means of an eccentric. According to a particularly advantageous embodiment of the invention the eccentric has a screw head, which is accessible from the rear side of the plate. Consequently, the rest position of the hammer can be corrected more quickly and easily, since neither the hands nor the dial must be disassembled for this.

BRIEF DESCRIPTION OF THE DRAWINGS

A preferred exemplary embodiment of the invention is described below with reference to the attached figures, which in detail show.

DETAILED DESCRIPTION

Figure 1:
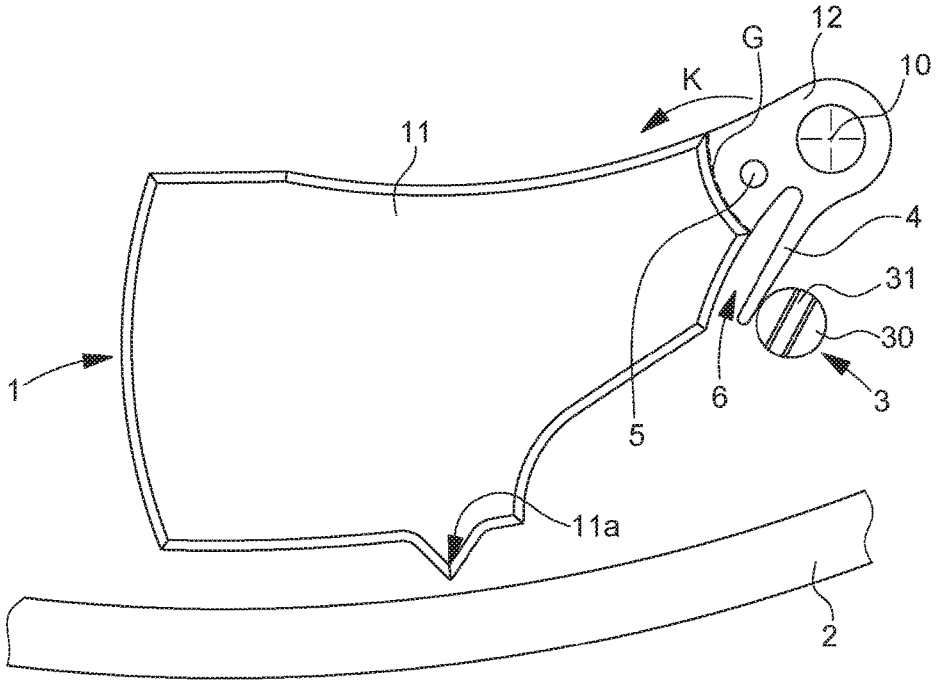
FIG. 1: a plan view of a hammer with an elastic adjustable stop and of an eccentric for its adjustment.

FIG. 1 shows a view of a hammer 1 of a movement of a clock according to a preferred embodiment of the invention. In this case the hammer 1 is shown in its rest position, in which it does not touch the gong 2.

Figure 2:
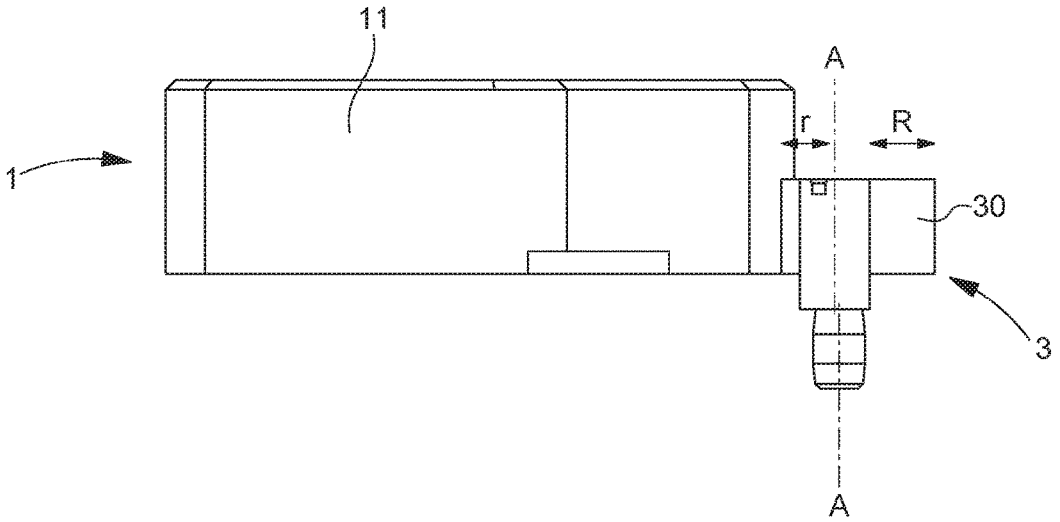
FIG. 2: a sagittal sectional view of the same striking mechanism parts as shown in FIG. 1.

For this, the external shape of the hammer 1 is configured such that an element with elastic properties has been added. The elastic element of the hammer 1 rests against an eccentric 3, which is rotatable around its axis and disposed with friction in a bore and is accessible from the rear side of the plate. As a result of the eccentricity the distance between the hammer 1 and the gong 2 can be reduced or increased by rotating the eccentric 3. FIG. 2 relates to the adjustment of the rest position of the hammer 1, wherein the larger radius R and the smaller radius r of the screw head 30 of the eccentric are illustrated around its axis A-A. When a screwdriver is inserted in the screw groove 31 of the screw head 30 shown in FIG. 1 and turned, the hammer 1 is swung upwards or downwards around its rotational axis 10, as applicable. When it is located in the position shown in FIG. 2, i.e. when it supports its adjustable elastic stop 4 on the smaller radius r of the eccentric, the hammer 1 can only be swung upwards.

On the one hand, the eccentric 3 is preferably arranged between the rotational axis 10 of the hammer 1 and the gong 2 in order to leave as much free space as possible on the plate for other gear trains and modules besides the striking mechanism. In this case, the aim is to keep the distance between the rotational axis 10 and the axis A-A of the eccentric as small as possible so that the swivel angles become all the greater depending on the rotation of the eccentric 3, and therefore the adjustment range becomes correspondingly broader.

On the other hand, the screw groove 31 of the eccentric 3, as shown in FIG. 1, is accessible from the rear side of the plate, and therefore the rest position of the hammer 1 can be corrected more quickly and easily by only having to open the casing of the clock instead of disassembling the hands and the dial, as is usual for a conventional counterspring.

According to the preferred embodiment of the invention, which is shown in FIGS. 1 and 2, the hammer 1 is configured in two parts, namely a thick main piece 11, on which the striking part, here the striking edge 11*a*, is configured and a thinner joining part 12, which has a bore and is movable around the rotational axis 10. The adjustable elastic stop 4 is preferably arranged on the joining part 12, because it thus lies closer to the rotational axis 10 of the hammer 10 and can thus provide a broad adjustment range when the eccentric 3 cooperates therewith. The elastic adjustable stop 4 is preferably configured in one piece with this joining part 12, which means a fastening step can be omitted and at the same time allows a simple fabrication, e.g. with milling or eroding, as a result of the lower mass of this part compared to the main piece 11. The entire hammer 1 is preferably made from steel and the entire hammer 1 is configured in one piece.

The adjustable elastic stop 4 preferably has a needle-like shape, which optimises its absorption properties. Thus, a kind of fully integrated counterspring is obtained for this and a separate part is no longer needed. The needle-shaped elastic adjustable stop 4 is preferably configured in a direction that extends from the rotational axis 10 of the hammer 1, so that the torques exerted at its point are maximised. According to the preferred embodiment of FIG. 1, the needle-shaped elastic adjustable stop 4 is arranged next to an elongated opening 6. Its fabrication is therefore simple and convenient, because only a little substance must be cut from the hammer 1 to subsequently obtain the desired needle shape for the elastic stop 4 next to the shaped recess, i.e. the opening 6.

As shown in FIG. 1, a drive pin 5 is fastened to the joining part 12 and cooperates with the leverage (not shown) of the striking mechanism. At the beginning of the striking action the hammer 1 moves away from the gong 2 and a so-called drive spring—likewise not shown—is thus tensioned. After reaching the maximum lift, the hammer 1, accelerated by this drive spring, drops down to its rest position. However, as a result of the energy of the hammer 1, the elastic element of the hammer 1, i.e. the elastic adjustable stop 4, deflects slightly and allows the hammer 1 to briefly touch the gong 2, which is struck by the striking edge 11*a*. The gong 2 is stimulated to oscillate as a result of this.

In order to increase the acceleration of the main piece 11 of the hammer, a kind of articulated joint G—shown in dotted lines in FIG. 1—can be provided between the joining part 12 and the main piece 11 in that, for example, a swivelling middle link is arranged between these or a thinner section is configured in front of the thickened section of the main piece 11, so that the deformation forces are intensified. Alternatively, for this a material can be selected for the joining part 12 that is more elastic than that used for the main piece (NB: in contrast to a conventional counterspring, which is generally made from a more rigid material compared to that of the drive spring). However, the aim of all these proposed variants remains to obtain a kind of catapult effect that can be adapted according to requirements.

However, the person skilled in the art will understand from this description that the subject of the present invention covers other variants for the elastic adjustable stop. This new feature allows both the conventional counterspring and its fastening screw to be replaced in a striking mechanism without the desired absorption function for the hammer being impaired, and thus enables its adjustment and subsequent correction of the swivelling position to be simplified. Other materials, forms and directions of expansion for this elastic adjustable stop, amongst other things, are entirely possible without departing from the framework of the invention. The mentioned preferred embodiment presented in detail thus applies only as an example and should not be deemed as a restriction for the interpretation of the claims.

LIST OF REFERENCE NUMBERS

1 hammer
10 hammer rotational axis
11 main piece of hammer
11*a* striking edge
12 joining part
2 gong
3 eccentric
30 screw head
31 screw groove
4 elastic stop
5 drive pin
6 opening
A-A axis of the eccentric
G articulated joint
K catapult
r small radius of the eccentric
R large radius of the eccentric

The invention claimed is:

1. A striking mechanism, comprising:

a hammer comprising a main piece and a joining part, the main piece including a striking part and the joining part including an elastic stop that is needle-shaped, wherein the main piece is thicker than the joining part; and an eccentric supporting said elastic stop in a rest position of the hammer.

2. The striking mechanism according to claim wherein the elastic stop is configured in one piece with the hammer.

3. The striking mechanism according to claim 1, wherein the elastic stop is configured in a direction that extends from a rotational axis of the hammer.

4. The striking mechanism according to claim 3, wherein the elastic stop is arranged next to an elongated opening.

5. The striking mechanism according to claim 1, wherein the hammer is configured to swivel around a rotational axis, wherein said hammer contains the main piece, on which the striking part is configured, and has the joining part movable around said rotational axis.

6. The striking mechanism according to claim 5, wherein a drive pin is additionally fastened to said joining part, and the hammer has an articulated joint between said joining part and said main piece.

7. The striking mechanism according to claim 5, wherein the joining part is made from a more elastic material than that used for the main piece.

8. The striking mechanism according to claim 1, wherein the eccentric has a screw head, which is accessible from a side of a plate.

9. The striking mechanism according to claim 1, wherein the eccentric is arranged between the rotational axis of the hammer and a gong.

10. The striking mechanism according to claim 1, wherein the eccentric includes a screw head.

11. The striking mechanism according to claim 1, wherein a drive pin is additionally fastened to said joining part, and the hammer has an articulated joint between said joining part and said main piece.

12. A striking mechanism, comprising:

a hammer comprising an elastic stop that is needle-shaped; and an eccentric supporting said elastic stop in a rest position of the hammer, wherein the elastic stop is configured in a direction that extends from a rotational axis of the hammer.

13. The striking mechanism according to claim 12, wherein the elastic stop is arranged next to an elongated opening.

14. A striking mechanism, comprising:

a hammer comprising an elastic stop that is needle-shaped; and an eccentric supporting said elastic stop in a rest position of the hammer, wherein the eccentric has a screw head that is accessible from a side of a plate.

15. The striking mechanism according to claim 14, wherein the hammer is configured to swivel around a rotational axis, wherein said hammer includes a main piece, on which a striking part is configured, and a joining part movable around said rotational axis, wherein the elastic stop is configured on the joining part.

16. The striking mechanism according to claim 15, wherein a drive pin is additionally fastened to said joining part, and the hammer has an articulated joint between said joining part and said main piece.

17. The striking mechanism according to claim 15, wherein the joining part is made from a more elastic material than that used for the main piece.

* * * * *